US009675164B2

(12) United States Patent
McDuffee

(10) Patent No.: US 9,675,164 B2
(45) Date of Patent: Jun. 13, 2017

(54) CONVERTIBLE BACKPACK FRAME

(71) Applicant: Michael E. McDuffee, Mount Holly, NC (US)

(72) Inventor: Michael E. McDuffee, Mount Holly, NC (US)

( * ) Notice: Subject to any disclaimer, the term of this patent is extended or adjusted under 35 U.S.C. 154(b) by 131 days.

(21) Appl. No.: 14/790,029

(22) Filed: Jul. 2, 2015

(65) Prior Publication Data

US 2017/0000245 A1 Jan. 5, 2017

(51) Int. Cl.

| | |
|---|---|
| ***A45F 4/06*** | (2006.01) |
| ***A45F 4/04*** | (2006.01) |
| ***A45F 3/10*** | (2006.01) |
| ***A47C 29/00*** | (2006.01) |
| ***A47C 17/66*** | (2006.01) |
| ***A47C 17/70*** | (2006.01) |
| *A45F 4/00* | (2006.01) |

(52) U.S. Cl.

CPC ..... *A45F 4/06* (2013.01); *A45F 3/10* (2013.01); *A45F 4/04* (2013.01); *A47C 17/66* (2013.01); *A47C 17/70* (2013.01); *A47C 29/003* (2013.01); *A45F 2004/006* (2013.01)

(58) Field of Classification Search

CPC ..... A45F 4/06; A45F 2004/006; A45F 4/04; A45F 4/02; A45F 4/03

USPC ..... 224/154, 156, 186, 187

See application file for complete search history.

(56) References Cited

U.S. PATENT DOCUMENTS

| | | | | | |
|---|---|---|---|---|---|
| 3,158,299 | A * | 11/1964 | Weir | A45F 4/02 | 114/354 |
| 3,601,825 | A * | 8/1971 | Moorhead | A47C 29/003 | 135/117 |
| 4,056,857 | A | 11/1977 | Quantz | | |
| 4,773,708 | A * | 9/1988 | Nastu | A47C 1/143 | 297/17 |
| 4,885,812 | A | 12/1989 | Lindner | | |
| 4,955,517 | A | 9/1990 | Maresca | | |
| 5,083,324 | A * | 1/1992 | Strong | A47K 11/04 | 182/187 |
| 5,489,052 | A | 2/1996 | Blood, Jr. | | |
| 5,590,825 | A * | 1/1997 | Murdock | A45F 4/06 | 224/153 |
| 6,023,792 | A * | 2/2000 | Croucher | A47K 11/02 | 4/458 |
| 6,062,446 | A | 5/2000 | Daneau | | |
| 6,202,907 | B1 | 3/2001 | Higgins | | |

(Continued)

*Primary Examiner* — Adam Waggenspack

(74) *Attorney, Agent, or Firm* — Hammer & Associates, P.C.

(57) ABSTRACT

A backpack frame is convertible from a frame position to a cot position. The backpack frame includes: a first U-shaped member having a closed end and an open end, a first intermediate member having a distal end and a proximal end, the proximal end is hingably connected to the open end of the first U-shaped member, a second intermediate member having a distal end and a proximal end, the distal end of the first intermediate member is hingably connected to the distal end of the second intermediate member, a second U-shaped member having a closed end and an open end, the proximal end of the second intermediate member is hingably connected to the open end of the second U-shaped member. In the frame position, the first U-shaped member, the first intermediate member, the second intermediate member, and the second U-shaped member lie in a single plane.

18 Claims, 10 Drawing Sheets

(56) References Cited

U.S. PATENT DOCUMENTS

| | | | | |
|---|---|---|---|---|
| 6,651,853 | B2 | 11/2003 | Higgins et al. | |
| 7,118,172 | B1 | 10/2006 | Pattison-Sheets | |
| 8,113,396 | B2 * | 2/2012 | Schilly | A45F 3/10 224/155 |
| 2006/0261103 | A1 | 11/2006 | Strange | |
| 2007/0262102 | A1 | 11/2007 | Rininger et al. | |
| 2013/0126654 | A1 | 5/2013 | Lee | |
| 2014/0293592 | A1 * | 10/2014 | Hopper | H05B 33/0803 362/183 |

* cited by examiner

CONVERTIBLE BACKPACK FRAME

FIELD OF THE INVENTION

The invention is directed to a backpack frame that is convertible from a backpack frame worn on a hiker's back to a cot for the hiker.

BACKGROUND OF THE INVENTION

Backpacking is a popular activity. The backpacker (or hiker) packs into a remote area carrying all their gear to enjoy the wonders of nature and the rigors of the hike, and to test their outdoor skills. Compactness and light-weight are key factors in gear design for backpackers. The backpacker usually plans to sleep, in a sleeping bag, on the ground (or on a light-weight mattress—foam or air inflatable). But, the backpacker is likely to enjoy a cot, so that they can sleep off the ground. However, cots are typically heavy and bulky, and often are not suitable for the backpacking experience.

SUMMARY OF THE INVENTION

A backpack frame is convertible from a frame position to a cot position. The backpack frame includes: a first U-shaped member having a closed end and an open end, a first intermediate member having a distal end and a proximal end, the proximal end is hingably connected to the open end of the first U-shaped member, a second intermediate member having a distal end and a proximal end, the distal end of the first intermediate member is hingably connected to the distal end of the second intermediate member, a second U-shaped member having a closed end and an open end, the proximal end of the second intermediate member is hingably connected to the open end of the second U-shaped member.

In the frame position, the first U-shaped member, the first intermediate member, the second intermediate member, and the second U-shaped member lie in a single plane.

DESCRIPTION OF THE DRAWINGS

For the purpose of illustrating the invention, there is shown in the drawings a form that is presently preferred; it being understood, however, that this invention is not limited to the precise arrangements and instrumentalities shown.

DESCRIPTION OF THE INVENTION

Figure 1:
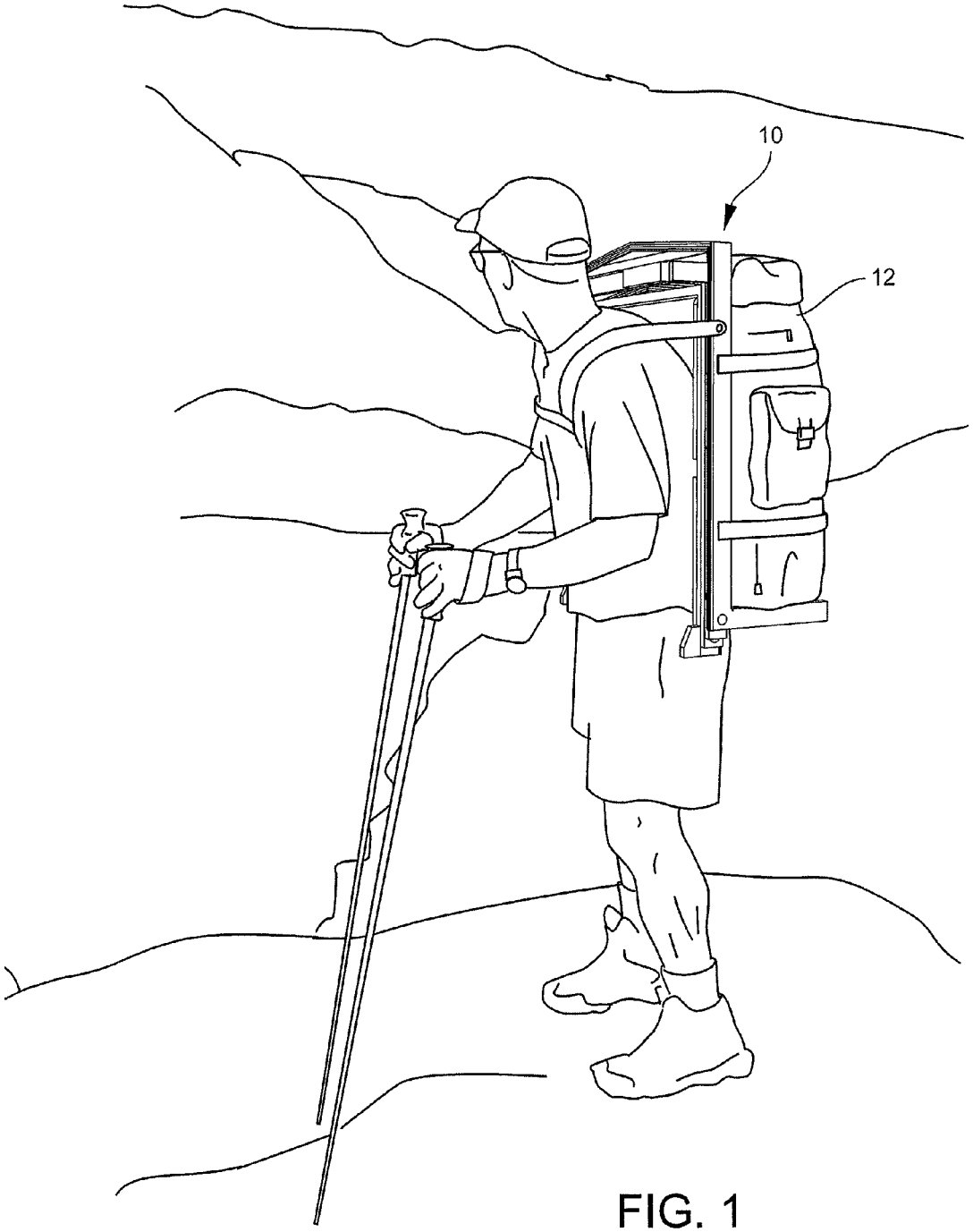
FIG. 1 is an environmental view of the inventive backpack frame with backpack worn by a backpacker, the backpack frame is in the frame position.
Figure 2:
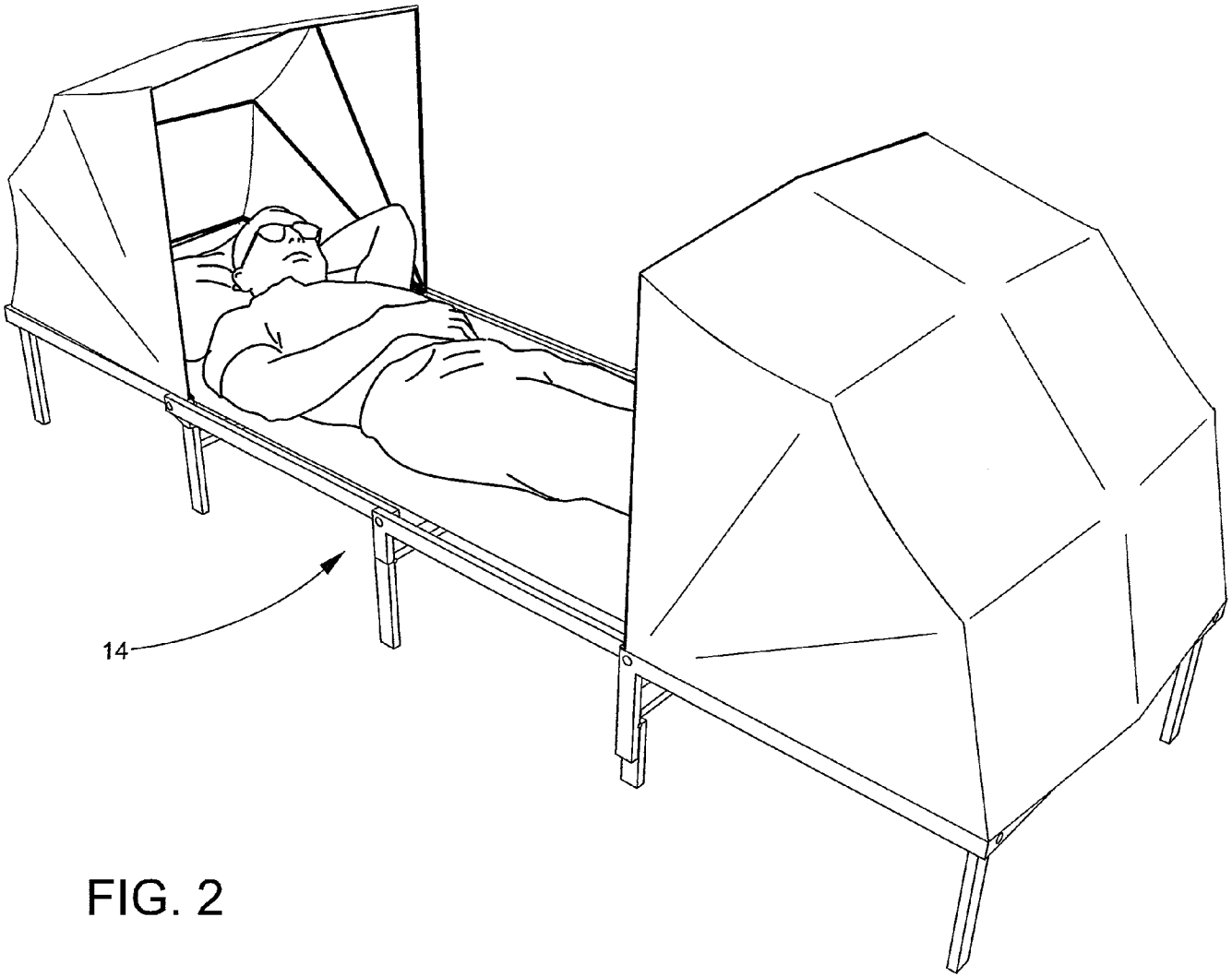
FIG. 2 is an environmental view of the inventive backpack frame with the backpacker laying on the cot and with canopies deployed, the backpack frame is in the cot position.

Referring to the drawings, where like elements have like numerals, there is shown in FIGS. 1 and 2, an embodiment of the inventive convertible backpack frame 10. In FIG. 1, the backpack frame 10 is an frame position. In the frame position, the frame 10 is in a fully collapsed configuration (discussed in greater detail below) and may carry a backpack 12. Backpack 12 may be any style backpack and may be detachably affixed to the frame 10 in any conventional manner. Frame 10 may have any number of conventional shoulder straps and waist belts, so that the frame 10 and backpack 12 may be worn in a comfortable and secure manner on the backpacker (or hiker). In FIG. 2, the backpack frame 10 is shown in a cot position 14 (discussed in greater detail below). In the cot position, the backpacker may recline in a resting area, and optionally the resting area may be enclosed with a detachable canopy.

Figure 3:
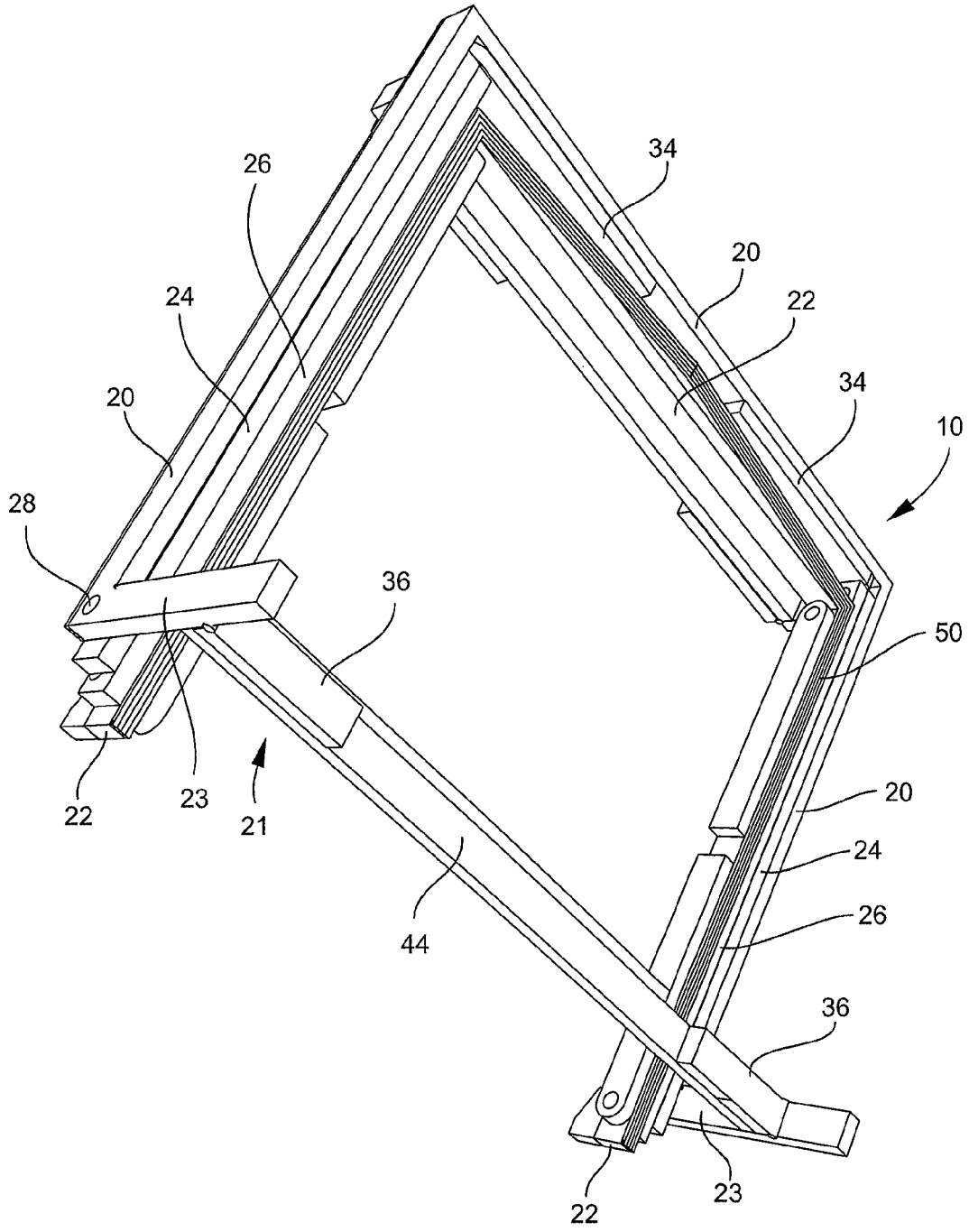
FIG. 3 is an illustration of the inventive backpack frame, in the frame position, all members lying in a single plane.

In FIG. 3, the backpack frame 10 is shown in the frame position. In general, the backpack frame (best seen in FIG. 7) includes: a first U-shaped member 20, a second U-shaped member 22, a first intermediate member 24, and a second intermediate member 26. While the inventive frame 10 shown in the figures has generally rectangular members (and legs/braces), it will be understood that the invention is not so limited and those members (and legs/braces) may have any cross-section (for example, the cross-section may be circular, annular, square, and/or star). Moreover, the members (and legs/braces) may be made of any material (for example, wood, metal (e.g., aluminum), or plastic).

In the frame position (see FIG. 3), the first and second U-shaped members and the first and second intermediate members lie in a single plane. Another way of envisioning this concept of the single plane is to understand that the first intermediate member nests within the first U-shaped member, the second intermediate member nests within the first intermediate member, and the second U-shaped member nests within the second intermediate member, when the frame 10 is in the frame position. By so doing, the frame is compact.

The first U-shaped member 20 has a closed end and an open end (best seen in FIG. 3). A pack rest 21 is affixed to the open end of the first U-shaped member 20. The pack rest 21 extends away (rearwardly) from the single plane. The pack rest may include rearwardly extending members 23 with a brace 44 therebetween.

The first intermediate member 24 includes forwardly extending member 25 (best seen in FIG. 4) with a brace 46 therebetween. Members 25 extend away from the single plane.

Referring to FIGS. 3-8, the deployment of the backpack frame 10 from the frame position (e.g., FIGS. 1 and 3) to the cot position (e.g., FIGS. 2, and 8-10) will be discussed. Note, all hingable connections discussed hereinafter are pivotable and lockable, in any conventional manner.

In FIG. 3, the frame 10 is in the frame position.

Figure 4:
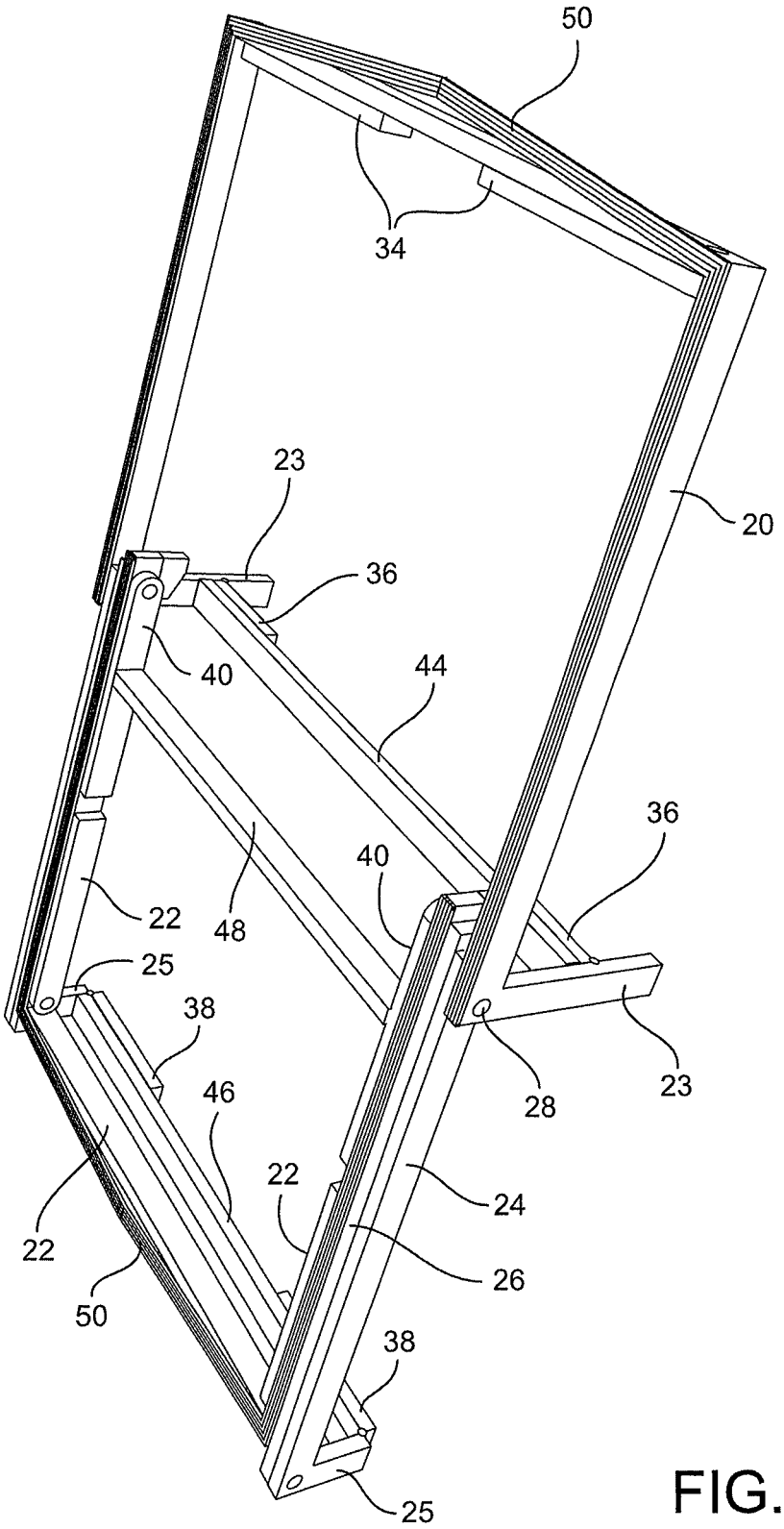
FIGS. 4-8 illustrate the deployment of the inventive backpack frame from the frame to the cot position.

In FIG. 4, the first U-shaped member 20 is unfolded. The open ends of the first U-shaped member 20 is hingably connected to proximal ends of the first intermediate member 24. The hingable connection may be via first hinge 28.

Figure 5:
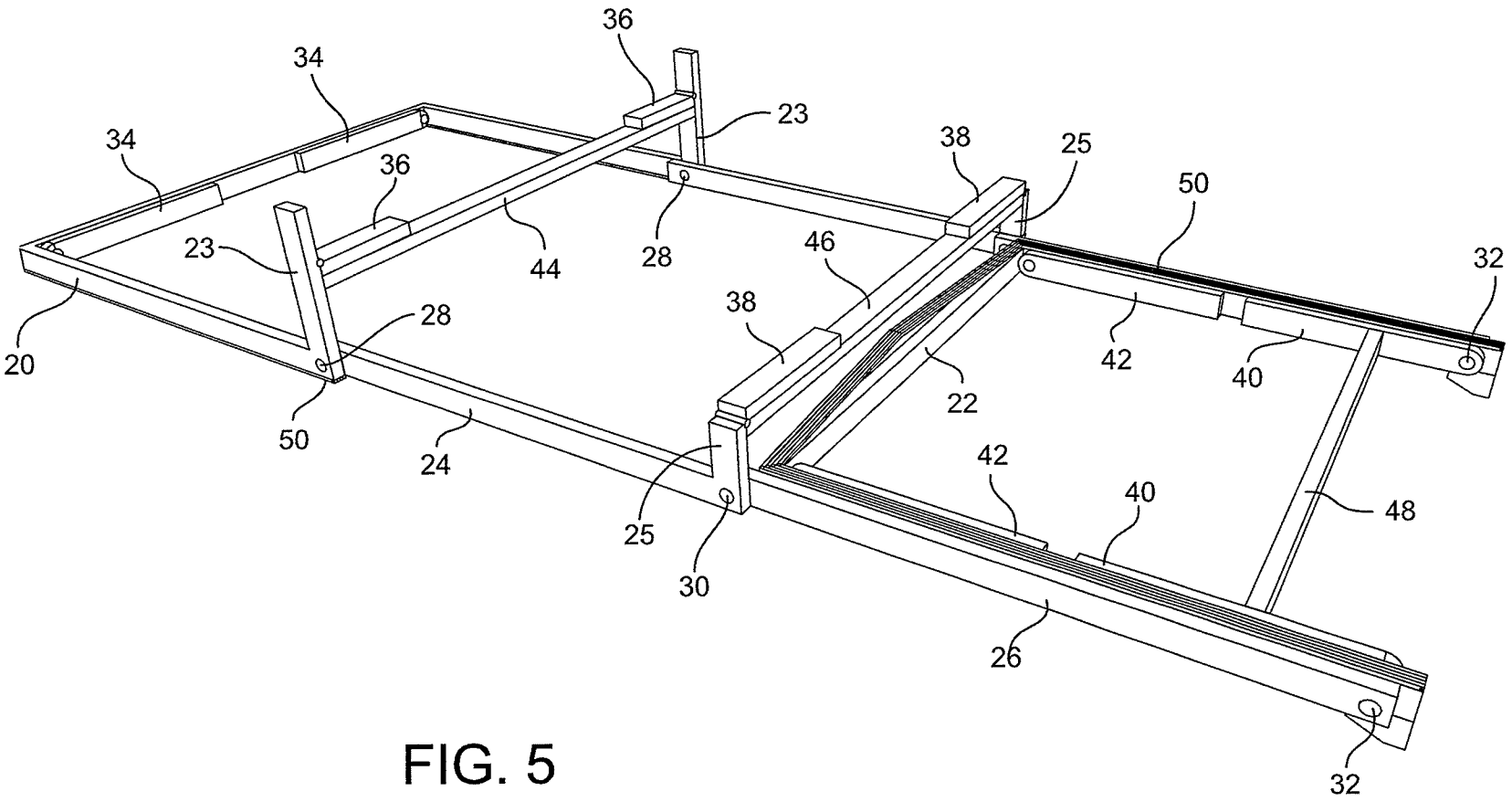

In FIG. 5, the second intermediate member 26 and second U-shaped member 22 are unfolded away from the first intermediate member 24. [Note: between FIGS. 4 and 5 the frame has been inverted.] A distal end of first intermediate member 24 is hingably connected to a distal end of the second intermediate member 26. The hingable connection may be via second hinge 30.

Figure 6:
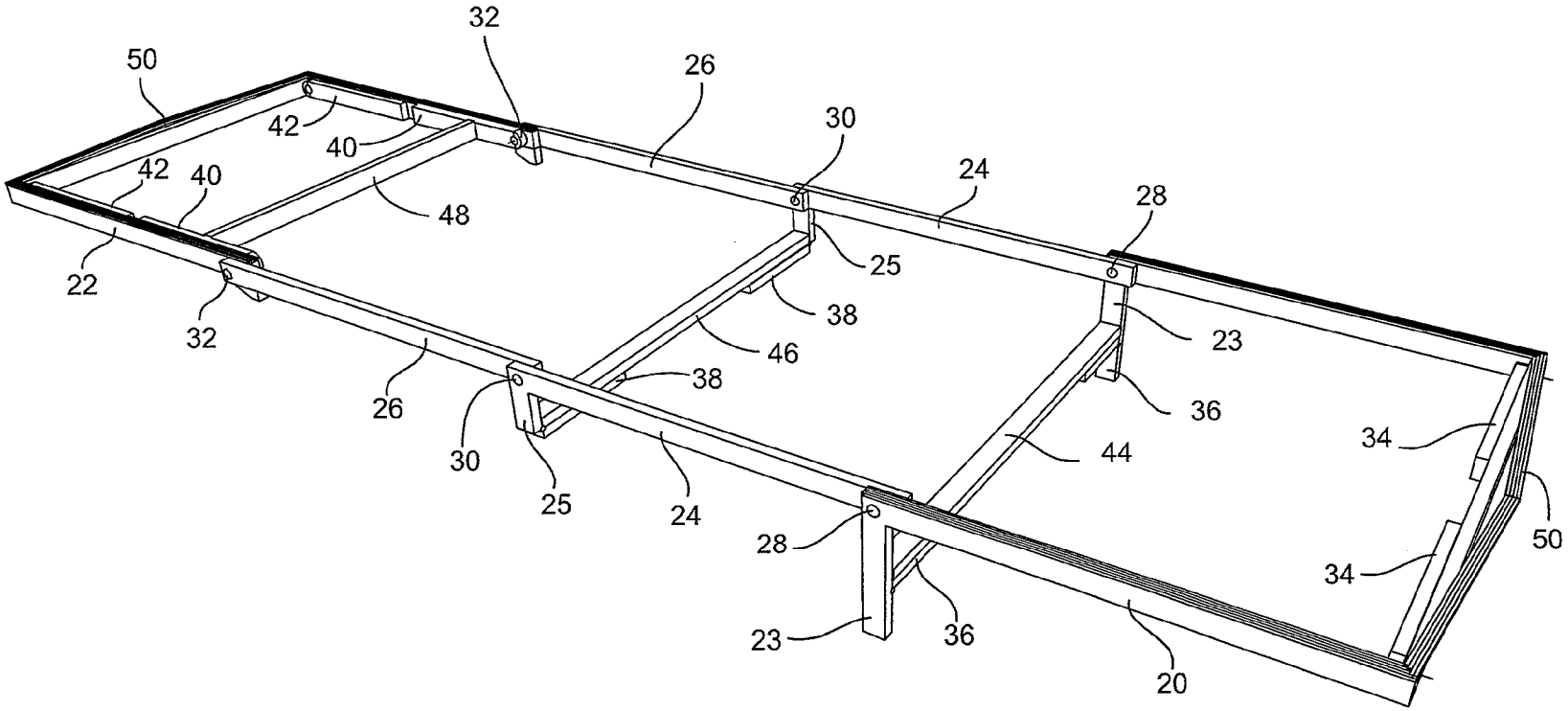

In FIG. 6, the second U-shaped member 22 is unfolded away from the second intermediate member 26. [Note: between FIGS. 5 and 6 the frame has been inverted.] A proximal end of the second intermediate member 26 is hingably connected to the open end of the second U-shaped member 22. The hingable connection may be via third hinge 32.

Figure 7:
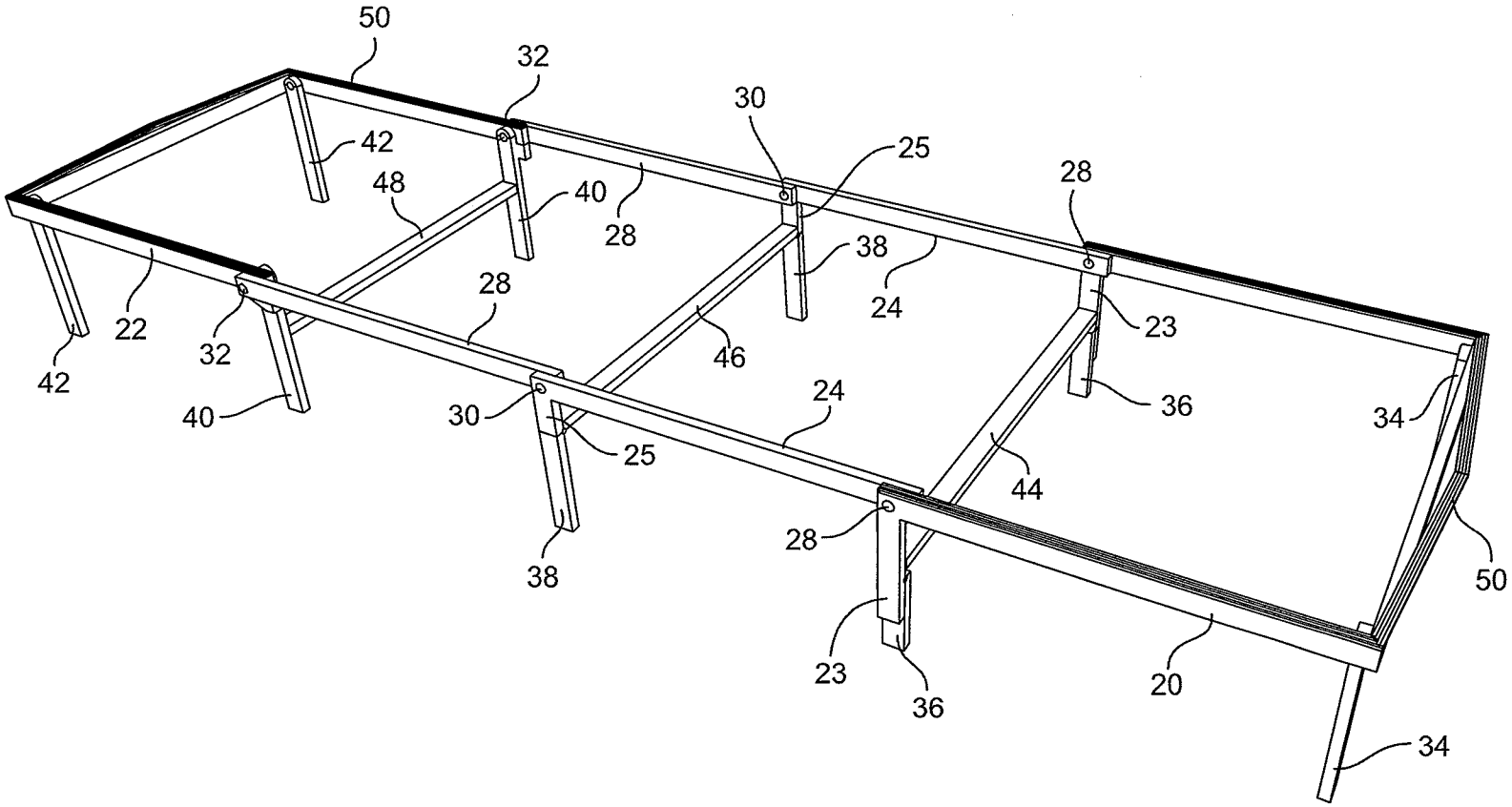

In FIG. 7, the legs are deployed. Legs 34, hingably connected to the closed end of the first U-shaped member 20, are swung down. The legs 34 are generally parallel to the closed end of the first U-shaped member 20 (in their non-deployed position), and generally at a right angle to the first U-shaped member 20 (in the deployed position). Legs 36, hingably connected to the members 23, are swung down. Legs 36 are generally parallel to brace 44 (in their non-deployed position), and generally at a right angle to the brace 44 (in the deployed position). Legs 38, hingably connected to the ends of members 25, are swung down. Legs 40 are connected to the open end of the second U-shaped member 22. Legs 40 are generally parallel to the second U-shaped member 22 (in the non-deployed position), and generally at a right angle the member 22 (in the deployed position). Legs 42, hingably connected adjacent the closed end of the second U-shaped member 20, are swung down. Legs 42 are generally parallel to the second U-shaped member (in the non-deployed position), and generally at a right angle to the second U-shaped member (in the deployed position).

Figure 8:
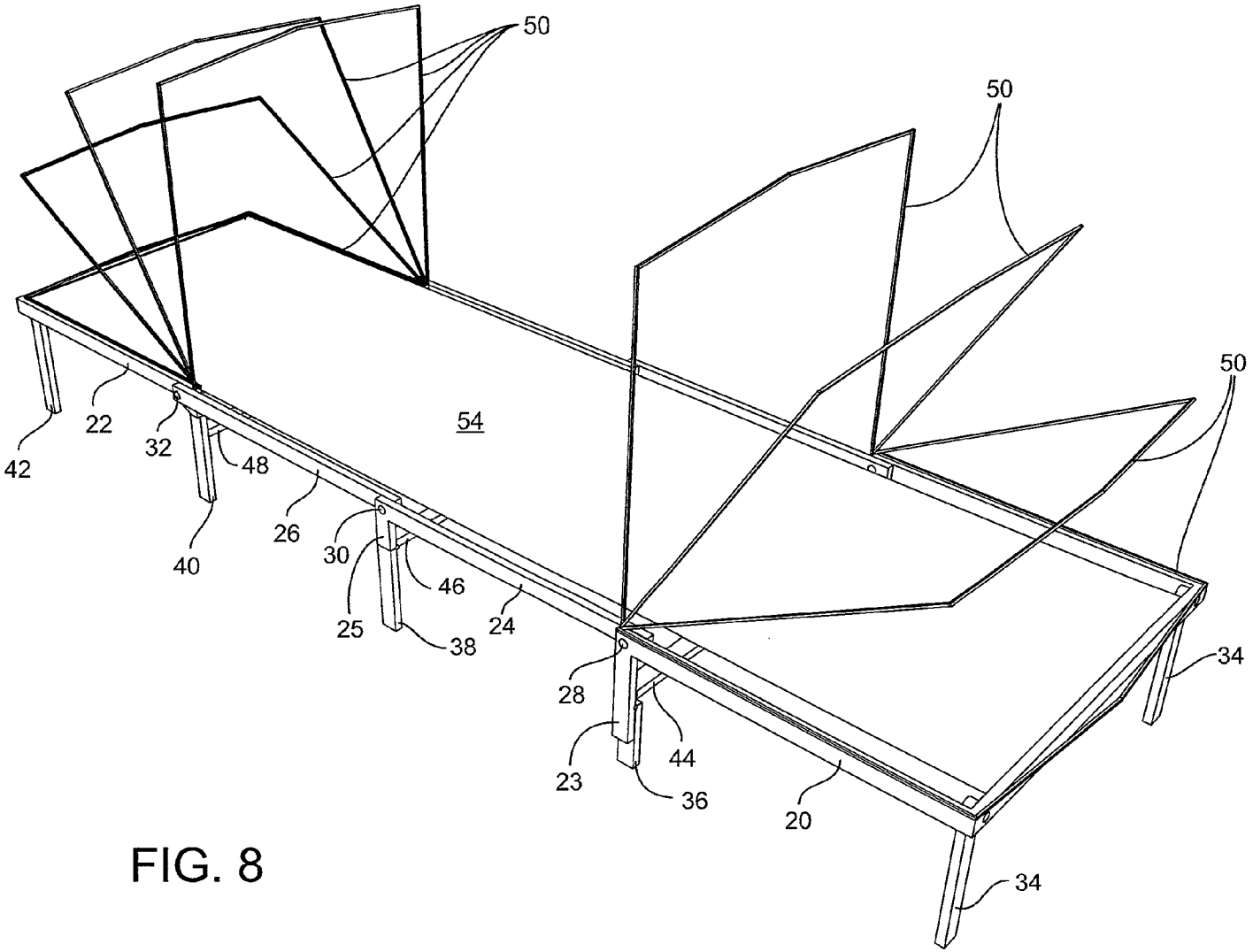

In FIG. 8, the frame 10, in the cot position. Is fitted with a rest 54. Rest 54 is the surface that the backpacker lays on in the rest area. Canopy struts 50 are raised. Each strut 50 is generally U-shaped. A plurality of struts 50 are hingably affixed to the open ends of the first and second U-shaped members 20 and 22.

Figure 9:
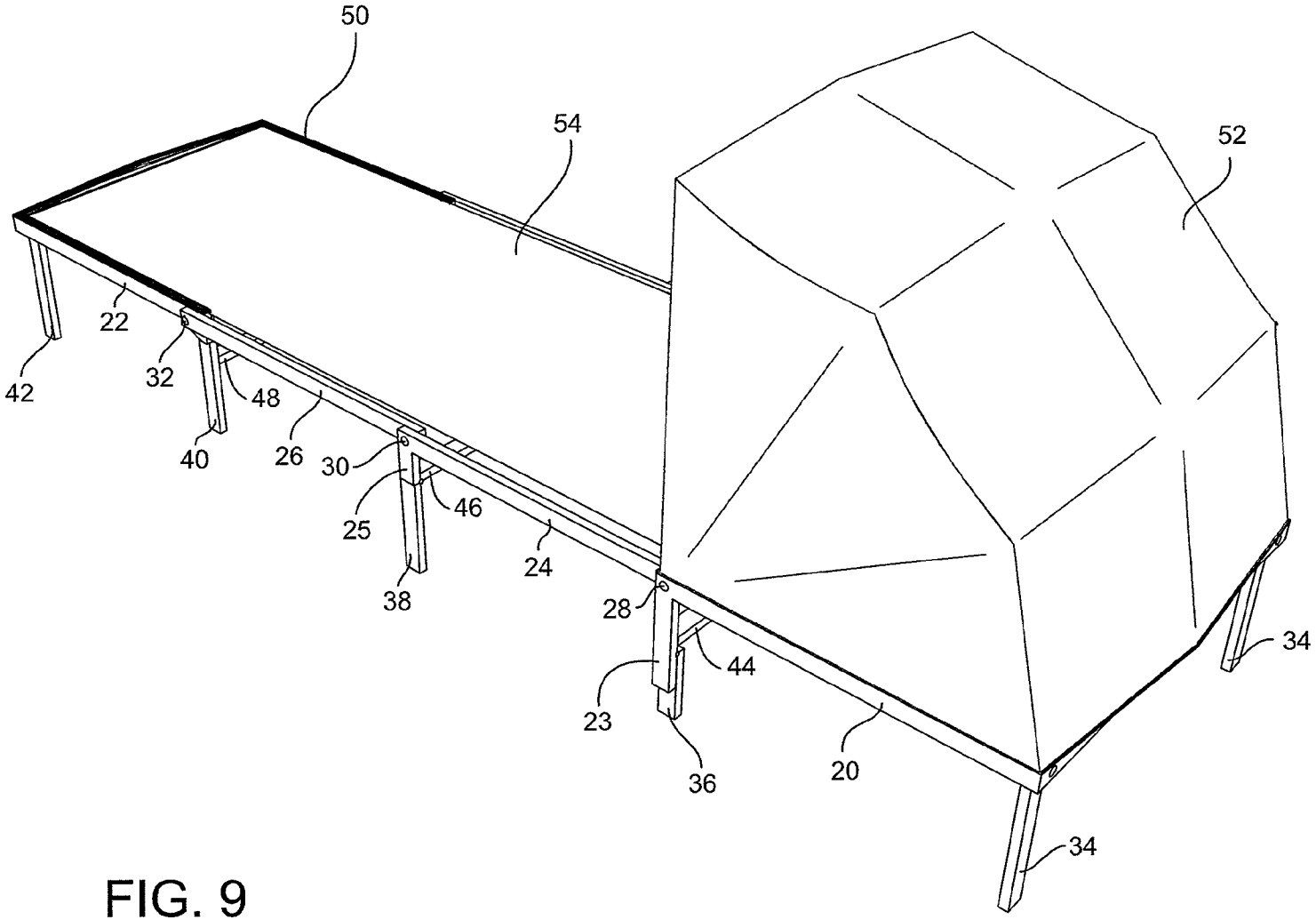
FIG. 9 is an illustration of the inventive backpack frame with one canopy deployed.
Figure 10:
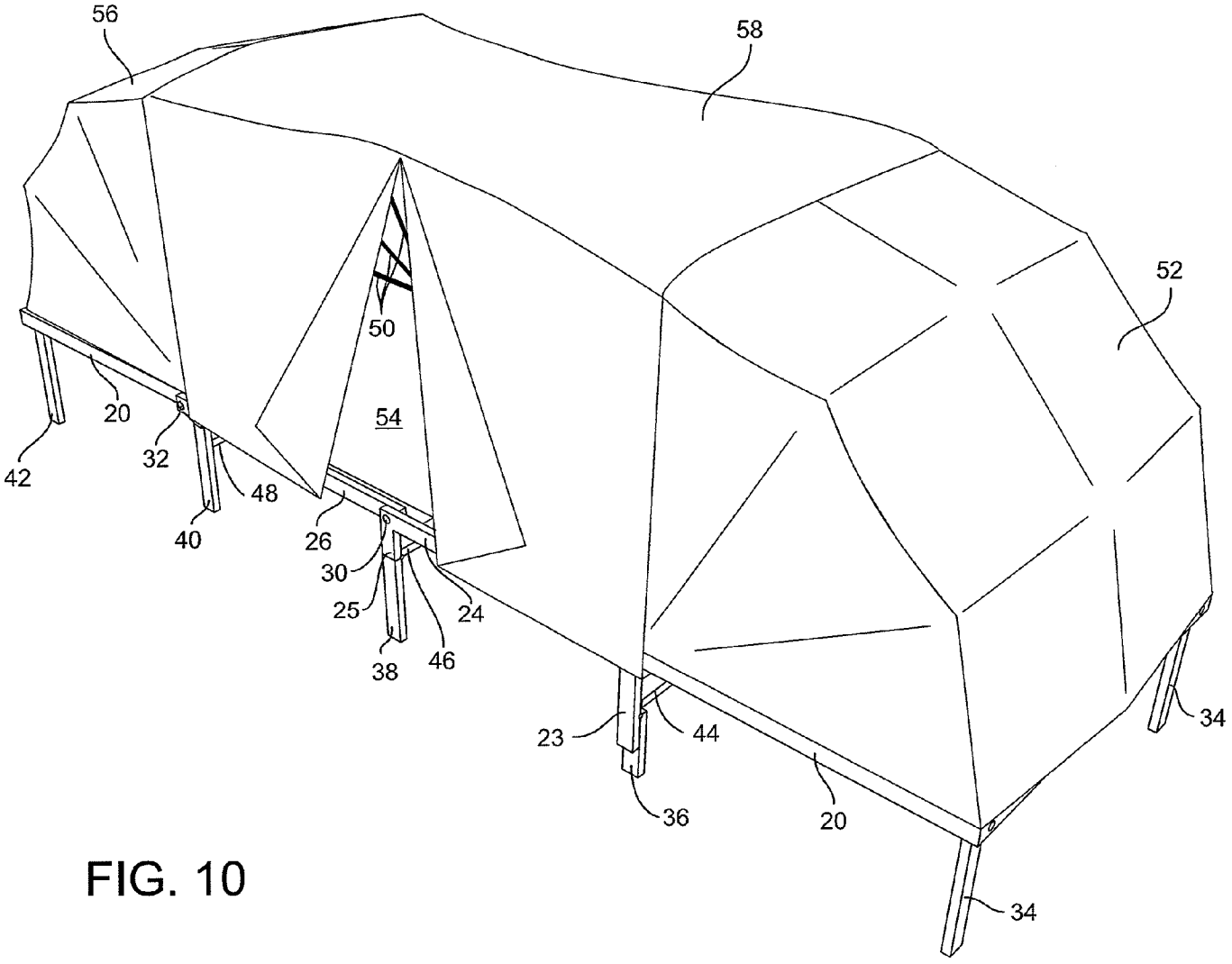
FIG. 10 is an illustration of the inventive backpack frame will all canopies deployed.

In FIGS. 9 and 10, the frame 10, in the cot position, is shown with a canopy. In FIG. 9, canopy 52 covers an end of the frame 10. In FIG. 10, canopies 52, 56, and 58 cover the entire resting area. Canopies may be affixed to the struts and each other in any conventional manner (e.g., hook & loop fastener, straps, zippers, and the like).

Additionally, the frame 10 may be equipped with a wire harness (not shown), so that the rechargeable devices (e.g., cellphones, radios, laptops computers, ereaders, or the like) may be connected with a energy source located outside of the frame. In one embodiment, the wire harness is threaded through the tubular members of the frame 10.

While the inventive frame may be used in recreational applications, it may also be used military situations.

The present invention may be embodied in other forms without departing from the spirit and the essential attributes thereof, and, accordingly, reference should be made to the appended claims, rather than to the foregoing specification, as indicating the scope of the invention.

I claim:

1. A backpack frame convertible between a frame worn by a hiker to a cot for the hiker, the backpack frame comprises:

a first U-shaped member having a closed end and an open end, a first intermediate member having a distal end and a proximal end, the proximal end is hingably connected to the open end of the first U-shaped member, a second intermediate member having a distal end and a proximal end, the distal end of the first intermediate member is hingably connected to the distal end of the second intermediate member, a second U-shaped member having a closed end and an open end, the proximal end of the second intermediate member is hingably connected to the open end of the second U-shaped member, the second U-shaped member further includes a first pair of legs hingably connected at a closed end of the second U-shaped member and a second pair of legs with a brace therebetween hingably connected to the second U-shaped member, and the backpack frame is convertible from a frame position to a cot position, in the frame position, the first U-shaped member, the first intermediate member, the second intermediate member, the second U-shaped member, the first pair of legs connected to the second U-shaped member, and the second pair of legs connected to the second U-shaped member lie in a single plane.

2. The back pack frame of claim 1 wherein the first intermediate member nests within the first U-shaped member, the second intermediate member nests within the first intermediate member, and the second U-shaped member nests within the second intermediate member, when the backpack frame is in the frame position.

3. The backpack frame of claim 1 wherein the first U-shaped member includes a pack rest.

4. The backpack frame of claims 3 wherein the pack rest extends away from the single plane.

5. The backpack frame of claim 3 wherein the pack rest includes rearward extending members affixed at the open end of the first U-shaped member with a brace interconnecting the rearward extending members.

6. The backpack frame of claim 1 wherein the first U-shaped member includes a plurality of canopy struts movable from a collapsed position to a deployed position.

7. The backpack frame of claim 1 wherein the second U-shaped member includes a plurality of canopy struts movable from a collapsed position to a deployed position.

8. The backpack frame of claim 1 further comprises a canopy for enclosing a resting area when the backpack frame is in the cot position.

9. The backpack frame of claim 1 further comprises a pair of legs hingably connected at the closed end of the first U-shaped member.

10. The backpack frame of claim 1 wherein the pack rest further comprises a pair of legs, each leg hingably connected to each rearward extending member, and each leg is moveable from the brace to the rearward extending member in the cot position.

11. The backpack frame of claim 1 wherein the second intermediate member has no legs connected thereto.

12. The back pack frame of claim 1 wherein the first intermediate member includes a forwardly extending members at the distal end of the first intermediate member with a brace therebetween.

13. The backpack frame of claim 12 further comprises a leg hingably connected to an end of each forwardly extending member.

14. The backpack frame of claim 13 wherein each such leg is moveable between the brace and the forwardly extending member in the cot position.

15. The backpack frame of claim 1 further comprises a wire harness for connecting a rechargeable device and/or light within a resting area to an energy source when the backpack frame is in the cot position.

16. A backpack frame convertible between a frame worn by a hiker to a cot for the hiker, the backpack frame comprises:

a first U-shaped member having a closed end and an open end, a first intermediate member having a distal end and a proximal end, the proximal end is hingably connected to the open end of the first U-shaped member, a second intermediate member having a distal end and a proximal end, the distal end of the first intermediate member is hingably connected to the distal end of the second intermediate member, a second U-shaped member having a closed end and an open end, the proximal end of the second intermediate member is hingably connected to the open end of the second U-shaped member, and wherein the backpack frame is convertible from a frame position to a cot position, wherein the first intermediate members nests within the first U-shaped member, the second intermediate member nests within the first intermediate member, and the second U-shaped member nests within the second intermediate member, when the backpack frame is in the frame position, wherein the first U-shaped members includes a pack rest, the pack rest extends away from the single plane, and the pack rest includes rearward extending members affixed at the open end of the first U-shaped member with a brace interconnecting the rearward extending members, wherein the first U-shaped member includes a plurality of canopy struts movable from a collapsed position to a deployed position, wherein the second U-shaped member includes a plurality of canopy struts movable from a collapsed position to a deployed position, a canopy for enclosing a resting area when the backpack frame is in the cot position, a pair of first legs hingably connected at the closed end of the first U-shaped member, a pair of fifth legs hingably connected at the closed end of the second U-shaped member, a fourth pair of legs with a brace therebetween hingably connected to the second U-shaped member, the second intermediate member has no legs connected thereto, wherein the first intermediate member includes a forwardly extending members at the distal end of the first intermediate member with a brace therebetween, a pair of third legs are hingably connected to an end of the forwardly extending member, and a wire harness for connecting a rechargeable device and/or light within a resting area to an energy source when the backpack frame is in the cot position wherein in the frame position the first U-shaped member, the first intermediate member, the second U-shaped member, the fourth pair of legs connected to the second U-shaped member, and the fifth pair of legs connected to the second U-shaped member lie in a single plane.

17. The backpack frame of claim 16 wherein the pack rest further comprises a pair of legs, each leg hingably connected to each rearward extending member, and each leg is moveable from the brace to the rearward extending member in the cot position.

18. The backpack frame of claim 16 wherein each leg is moveable between the brace and the forwardly extending member in the cot position.

* * * * *